US011325623B2

(12) United States Patent
Koshino et al.

(10) Patent No.: US 11,325,623 B2
(45) Date of Patent: May 10, 2022

(54) RAIL BREAKAGE DETECTION DEVICE AND RAIL BREAKAGE DETECTION SYSTEM

(71) Applicant: Mitsubishi Electric Corporation, Tokyo (JP)

(72) Inventors: Daisuke Koshino, Tokyo (JP); Masashi Asuka, Tokyo (JP); Wataru Tsujita, Tokyo (JP); Tomoaki Takewa, Tokyo (JP); Yoshitsugu Sawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 365 days.

(21) Appl. No.: 16/475,792

(22) PCT Filed: Jan. 13, 2017

(86) PCT No.: PCT/JP2017/001139
§ 371 (c)(1),
(2) Date: Jul. 3, 2019

(87) PCT Pub. No.: WO2018/131151
PCT Pub. Date: Jul. 19, 2018

(65) Prior Publication Data
US 2019/0351923 A1 Nov. 21, 2019

(51) Int. Cl.
*B61L 23/04* (2006.01)
*B61L 3/18* (2006.01)
*B61L 27/04* (2006.01)

(52) U.S. Cl.
CPC ..... *B61L 23/044* (2013.01); *B61L 3/18* (2013.01); *B61L 27/04* (2013.01)

(58) Field of Classification Search
CPC ..... B61L 23/044; B61L 3/18; B61L 27/04
See application file for complete search history.

(56) References Cited

U.S. PATENT DOCUMENTS 9,469,198 B2 * 10/2016 Cooper ..... B60L 3/10
2001/0045495 A1 * 11/2001 Olson ..... B61L 23/044 246/121

(Continued)

FOREIGN PATENT DOCUMENTS

JP 2002294609 A 10/2002
JP 2006250572 A 9/2006

(Continued)

OTHER PUBLICATIONS

International Search Report (PCT/ISA/210) dated Apr. 18, 2017, by the Japan Patent Office as the International Searching Authority for International Application No. PCT/JP2017/001139.

(Continued)

*Primary Examiner* — Jason C Smith
(74) *Attorney, Agent, or Firm* — Buchanan, Ingersoll & Rooney PC

(57) ABSTRACT

A purpose of the invention is to provide a rail breakage detection device mountable also on a vehicle. The invention is directed to a rail breakage detection device that receives: transmission-device state information indicating whether a rail signal transmission device that sends a rail signal is normal; reception-device state information indicating whether a rail signal reception device that receives a voltage induced by the rail signal is normal; and reception state information indicating whether a voltage induced by the rail signal reception device is received, and the rail breakage detection device performs rail breakage detection on the basis of the transmission-device state information, the reception-device state information, and the reception state information.

7 Claims, 12 Drawing Sheets

(56) References Cited

U.S. PATENT DOCUMENTS

| | | | | |
|---|---|---|---|---|
| 2004/0105608 | A1* | 6/2004 | Sloman | B61L 23/045 385/12 |
| 2007/0152107 | A1* | 7/2007 | LeFebvre | B61L 25/025 246/169 R |
| 2015/0081214 | A1* | 3/2015 | Cooper | B61L 25/02 701/523 |
| 2018/0265106 | A1* | 9/2018 | Church | G01N 27/041 |
| 2019/0351923 | A1* | 11/2019 | Koshino | B61L 23/044 |

FOREIGN PATENT DOCUMENTS

| | | | | |
|---|---|---|---|---|
| JP | 2011207449 | A | 10/2011 | |
| JP | 2011207453 | A | 10/2011 | |
| JP | 2012091671 | A | 5/2012 | |
| WO | WO-2021013503 | A1 * | 1/2021 | B61L 15/0036 |

OTHER PUBLICATIONS

Notification of Reason for Refusal dated Apr. 2, 2019, issued in corresponding Japanese Application No. 2018-561764.

Office Action dated Sep. 3, 2019, issued in corresponding Japanese Patent Application No. 2018-561764, 10 pages including 6 pages of English translation.

Office Action dated Jun. 9, 2021, for corresponding Indian patent Application No. 201947026964, 4 pages.

* cited by examiner

RAIL BREAKAGE DETECTION DEVICE AND RAIL BREAKAGE DETECTION SYSTEM

FIELD

The present invention relates to a rail breakage detection device and to a rail breakage detection system.

BACKGROUND

One example of a conventional rail breakage detection device for detecting breakage of a rail on which a train runs is disclosed in Patent Literature 1. The rail breakage detection device disclosed in Patent Literature 1, which is installed at a low cost, is capable of detecting rail breakage on the ground, using a return current.

CITATION LIST

Patent Literature

Patent Literature 1: Japanese Patent Application Laid-open No. 2012-91671

SUMMARY

Technical Problem

For the foregoing conventional technology, unfortunately, rail breakage can be detected on the ground, but cannot be detected on the vehicle.

The present invention has been made in view of the foregoing, and it is an object of the present invention to provide a rail breakage detection device mountable also on a vehicle.

Solution to Problem

To solve the above problem and achieve the object, the present invention provides a rail breakage detection device, wherein the rail breakage detection device receives transmission-device state information indicating whether a rail signal transmission device to send a rail signal is normal, reception-device state information indicating whether a rail signal reception device to receive a voltage induced by the rail signal is normal, and reception state information indicating whether an induced voltage is received by the rail signal reception device, and the rail breakage detection device performs rail breakage detection on a basis of the transmission-device state information, the reception-device state information, and the reception state information.

Advantageous Effects of Invention

The present invention provides an advantage in being capable of providing the rail breakage detection device mountable also on the vehicle.

DESCRIPTION OF EMBODIMENTS

A rail breakage detection device and a rail breakage detection system according to embodiments of the present invention will be described in detail below with reference to the drawings. Note that these embodiments are not intended to limit the scope of this invention.

First Embodiment

Figure 1:
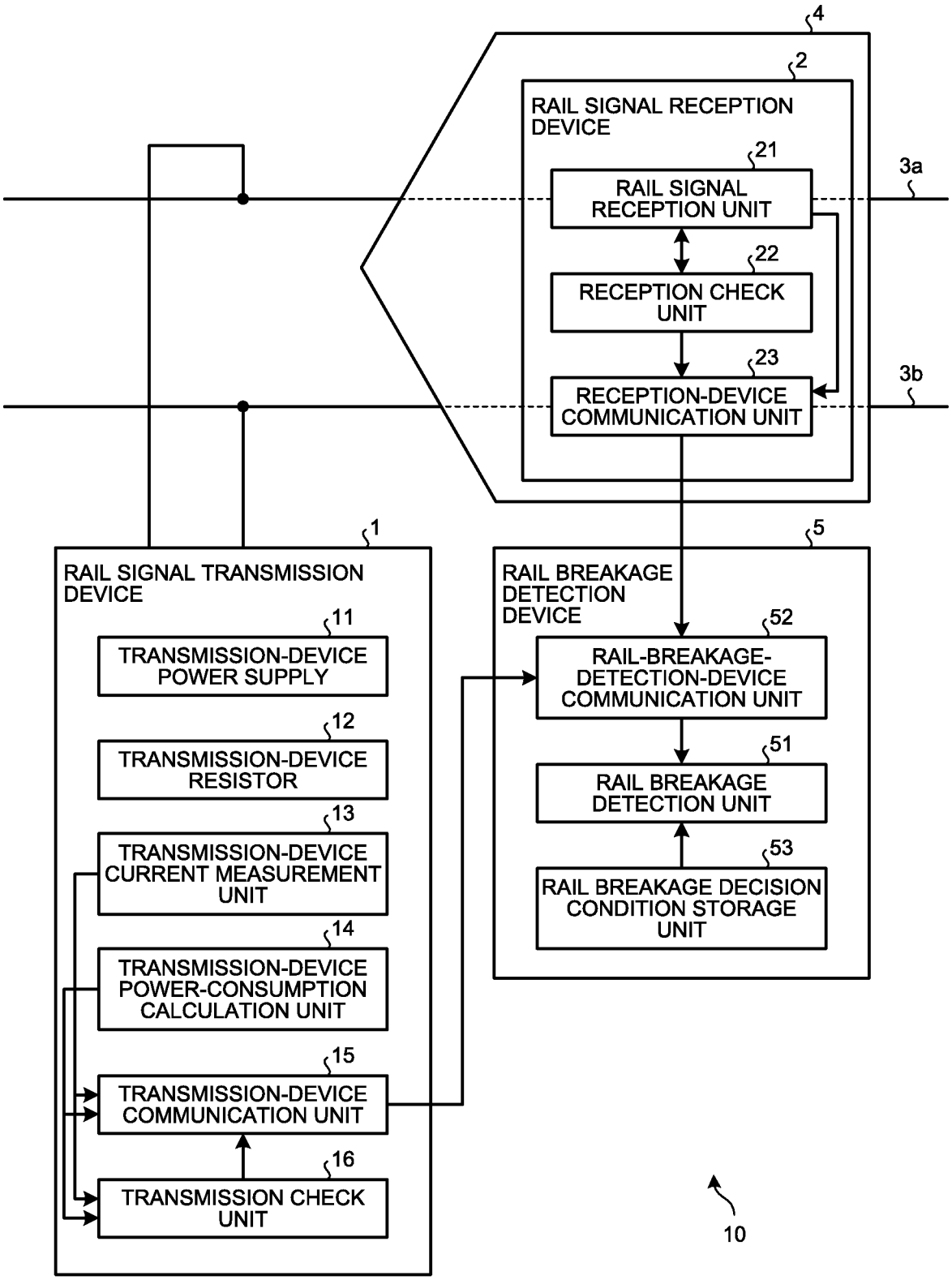
FIG. 1 is a diagram illustrating one example configuration of a rail breakage detection system including a rail breakage detection device according to a first embodiment.

FIG. 1 is a diagram illustrating one example configuration of a rail breakage detection system including a rail breakage detection device according to a first embodiment of the present invention. A rail breakage detection system 10 illustrated in FIG. 1 includes: a rail signal transmission device 1; a rail signal reception device 2 mounted on a vehicle 4 of a train running on rails 3*a* and 3*b*; and a rail breakage detection device 5.

The rail signal transmission device 1 illustrated in FIG. 1 is installed on the ground, and sends a rail signal to the rails 3*a* and 3*b*. The rail signal transmission device 1 includes a transmission-device power supply 11, a transmission-device resistor 12, a transmission-device current measurement unit 13, a transmission-device power-consumption calculation unit 14, a transmission-device communication unit 15, and a transmission check unit 16. The transmission-device power supply 11 is an alternating current (AC) power supply connected in series between the rail 3*a* and the rail 3*b*. The transmission-device resistor 12 is a resistor connected in series with the transmission-device power supply 11. The transmission-device current measurement unit 13 measures a current flowing through the transmission-device resistor 12. The transmission-device power-consumption calculation unit 14 calculates a power consumption from a product of a voltage of the transmission-device power supply 11 and a current measured by the transmission-device current measurement unit 13. The transmission-device communication unit 15 sends, to the rail breakage detection device 5, the current value and at least one of the power consumption value and transmission-device checked-state information. The current value is sent from the transmission-device current measurement unit 13. The power consumption value is sent from the transmission-device power-consumption calculation unit 14, and the transmission-device checked-state information is sent from the transmission check unit 16. The transmission check unit 16 checks the operational state of the rail signal transmission device 1, using the current measured by the transmission-device current measurement unit 13 or using the power value calculated by the transmission-device power-consumption calculation unit 14, and outputs the transmission-device state information. The term "rail signal" as used herein refers to a signal transmitted through the rails 3*a* and 3*b*. A rail signal may be a signal in any form that is identifiable for rail breakage detection, and examples thereof include a continuous wave having a predetermined amplitude or frequency, and a modulated signal having an amplitude, a frequency, or a phase resulting from predetermined modulation of the amplitude, of the frequency, or of the phase of a continuous wave.

The rail signal reception device 2 illustrated in FIG. 1 is disposed directly above the rails 3*a* and 3*b* and ahead of, i.e., spaced in the traveling direction from, the foremost axle of the vehicle 4. The following description is based on the assumption that, unless otherwise indicated, the term "vehicle" refers to the leading vehicle of the train. The rail signal reception device 2 includes a rail signal reception unit 21, a reception check unit 22, and a reception-device communication unit 23. The rail signal reception unit 21 receives a voltage induced by the rail signal, and outputs reception state information on the basis of this voltage. The reception check unit 22 checks the operational state of the rail signal reception unit 21, and outputs reception-device state information.

Specifically, the reception check unit 22 checks the operational state by sending, to the rail signal reception unit 21, a test signal whose result is known, and comparing the signal output by the rail signal reception unit 21 with the known result. The reception state information output by the rail signal reception unit 21 and the reception device state information output by the reception check unit 22 are sent to the rail breakage detection device 5 by the reception-device communication unit 23.

The rail breakage detection device 5 illustrated in FIG. 1 includes a rail breakage detection unit 51 and a rail-breakage-detection-device communication unit 52. The rail-breakage-detection-device communication unit 52 receives the information sent from the transmission-device communication unit 15 and from the reception-device communication unit 23, and outputs the received information to the rail breakage detection unit 51. The rail breakage detection unit 51 detects breakage of the rails 3*a* and 3*b* on the basis of the information output from the rail-breakage-detection-device communication unit 52. The rail breakage detection device 5 is mountable on the vehicle 4.

The rail breakage detection unit 51 makes a determination in accordance with Table 1 below, on the basis of the transmission-device state information, of the reception-device state information, and of the reception state information. Note that, in Table 1, a normal condition is indicated by a circle, while an abnormal condition is indicated by a cross mark. The rail breakage detection device 5 includes a rail breakage decision condition storage unit 53. The rail breakage decision condition storage unit 53 stores Table 1 in advance. The rail breakage detection unit 51 makes a determination on rail breakage detection by referring to the transmission-device state information sent from the rail signal transmission device 1, to the reception-device state information and the reception state information sent from the rail signal reception device 2, and to Table 1 stored in the rail breakage decision condition storage unit 53.

TABLE 1

| State Number | Transmission Device State | Power Reception Device State | Reception State | Decision |
|---|---|---|---|---|
| 1 | ○ | ○ | ○ | Normal Operation |
| 2 | ○ | ○ | X | Rail Breakage |
| 3 | ○ | X | ○ | Fault |
| 4 | ○ | X | X | Fault |
| 5 | X | ○ | ○ | Fault |
| 6 | X | ○ | X | Fault |
| 7 | X | X | ○ | Fault |
| 8 | X | X | X | Fault |

A description will now be provided regarding a case in which the rail signal transmission device and the rail signal reception device 2 are operating normally, that is, the transmission device state and the reception device state are "normal". In such case, if the rail signal reception device 2 receives a voltage induced by a rail signal from the rail signal transmission device 1, the reception state is "normal". That is, the transmission device state, the reception device state, and the reception state are "normal". The rail breakage detection unit 51 refers to Table 1 stored in the rail breakage decision condition storage unit 53, and if the transmission device state, the reception device state, and the reception state are all "normal", that is, if the case of state number 1 in Table 1 applies, the rail breakage detection unit 51 determines that there is no breakage in the pair of the rails 3*a* and 3*b*, that is, the rails 3*a* and 3*b* are operating normally.

If the rail signal transmission device 1 and the rail signal reception device 2 are operating normally, and thus the transmission device state and the reception device state are "normal", and the rail signal reception device 2 receives no voltage induced by a rail signal from the rail signal transmission device 1, then the reception state is "abnormal". That is, the transmission device state and the reception device state are "normal", and the reception state is "abnormal". The rail breakage detection unit 51 refers to Table 1 stored in the rail breakage decision condition storage unit 53, and if the transmission device state and the reception device state are "normal", and the reception state is "abnormal", that is, if the case of state number 2 in Table 1 applies, the rail breakage detection unit 51 determines that there is breakage in the pair of the rails 3*a* and 3*b*.

If the rail signal transmission device 1 is operating normally, but the rail signal reception device 2 is not operating normally, then the transmission device state is "normal", and the reception device state is "abnormal". In this case, the rail breakage detection unit 51 refers to Table 1 stored in the rail breakage decision condition storage unit 53, and if the transmission device state is "normal" and the reception device state is "abnormal", that is, if the case of state number 3 or state number 4 in Table 1 applies, the rail breakage detection unit 51 determines that there is a fault irrespective of the reception state. If the rail signal transmission device 1 is not operating normally, but the rail signal reception device 2 is operating normally, then the transmission device state is "abnormal", and the reception device state is "normal". In this case, the rail breakage detection unit 51 refers to Table 1 stored in the rail breakage decision condition storage unit 53, and if the transmission device state is "abnormal", and the reception device state is "normal", that is, if the case of state number 5 or state number 6 in Table 1 applies, the rail breakage detection unit 51 determines that there is a fault irrespective of the reception state. If neither of the rail signal transmission device 1 and the rail signal reception device 2 is operating normally, the transmission device state and the reception device state are "abnormal". In this case, the rail breakage detection unit 51 refers to Table 1 stored in the rail breakage decision condition storage unit 53, and if the transmission device state and the reception device state are "abnormal", that is, if the case of state number 7 or state number 8 in Table 1 applies, the rail breakage detection unit 51 determines that there is a fault irrespective of the reception state.

As described above, rail breakage can be detected when the rail signal transmission device 1 and the rail signal reception device 2 are operating normally, but a rail signal is not received. The rail breakage detection device 5 capable of detecting breakage of a rail can be mounted on the vehicle 4, thereby enabling rail breakage to be detected on a vehicle.

Although not illustrated, a component that detects the location of the vehicle may be further included in the configuration illustrated in FIG. 1 such that the location of the vehicle when only the reception state switches from "abnormal" to "normal", or the location of the vehicle when only the reception state switches from "normal" to "abnormal" can be identified to thereby identify the rail breakage location.

Note that the voltage received by the rail signal reception unit 21 rapidly changes at the rail breakage location. Thus, determination of the location when the voltage received by the rail signal reception unit 21 crosses a preset voltage threshold enables determination of the rail breakage location. In addition, in this case, the time point when a rail becomes broken due to the weight of the vehicle can be detected based on a cracked-rail state.

Figure 2:
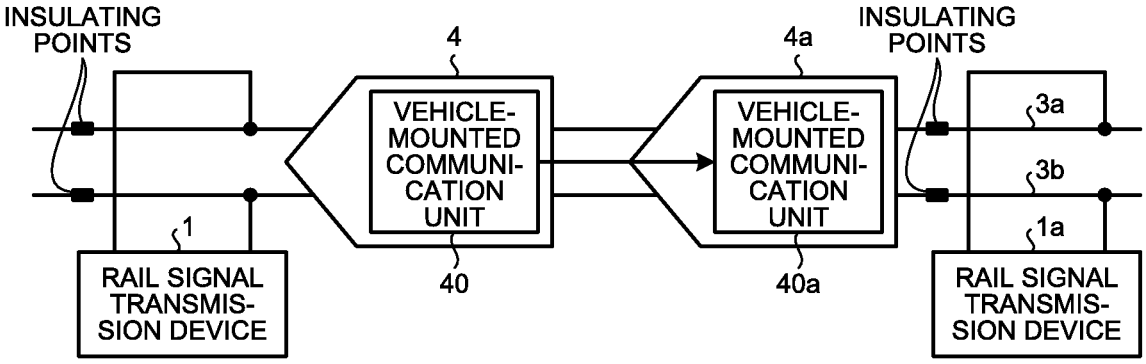
FIG. 2 is a diagram illustrating a state in which plural vehicles are present within a section defined by plural insulating points.

FIG. 2 is a diagram illustrating a state in which plural vehicles, which are the vehicle 4 and a vehicle 4*a*, are present within a section defined by plural insulating points. As illustrated in FIG. 2, insulating points are provided between the rail signal transmission device 1 and a rail signal transmission device 1*a*. As a result, the following vehicle 4*a* cannot receive a rail signal from both the rail signal transmission device 1 and the rail signal transmission device 1*a*. In this case, if the transmission device state and the reception device state are "normal", the rail breakage is detected in error.

Thus, to prevent such false detection, each of the trains is preferably designed such that one vehicle can identify information on the location of the insulated section where that vehicle is present and information on the location of the insulated section where another preceding vehicle is present. In addition, the rail breakage detection unit 51 is preferably designed not to determine that rail breakage occurs even when the rail signal reception device 2 is not receiving a rail signal in a case where the following vehicle and the preceding vehicle are present in the same section.

Figure 3:
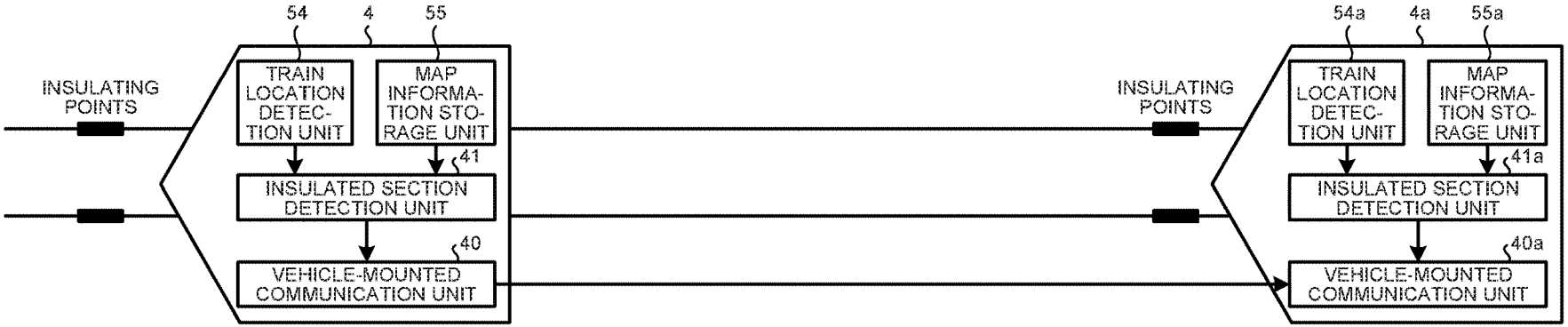
FIG. 3 is a diagram illustrating an example of a situation in which a vehicle is sending, directly to a following vehicle, information on a location of an insulated section where that vehicle is present.

FIG. 3 is a diagram illustrating an example of a situation in which the vehicle 4 is sending, directly to the following vehicle 4*a*, information on the location of the insulated section where the vehicle 4 is present. The vehicle 4 includes a vehicle-mounted communication unit 40, an insulated section detection unit 41, a train location detection unit 54, and a map information storage unit 55. The vehicle 4*a* includes a vehicle-mounted communication unit 40*a*, an insulated section detection unit 41*a*, a train location detection unit 54*a*, and a map information storage unit 55*a*. The train location detection unit 54 of the vehicle 4 detects the location of the train including the vehicle 4, and outputs the detected location to the insulated section detection unit 41. The insulated section detection unit 41 collates the train location output by the train location detection unit 54 with information on locations of insulated sections stored in the map information storage unit 55 to thereby detect the information on the location of the insulated section where the vehicle 4 is present, such that the insulated section detection unit 41 outputs the detected information to the vehicle-mounted communication unit 40. The vehicle-mounted communication unit 40 sends the information on the location of the insulated section to the vehicle-mounted communication unit 40*a* of the following vehicle 4*a* via wireless communication. This configuration enables each vehicle to identify the information on the location of the insulated section where the train of its own is present and the information on the location of the insulated section where the preceding train is present.

Figure 4:
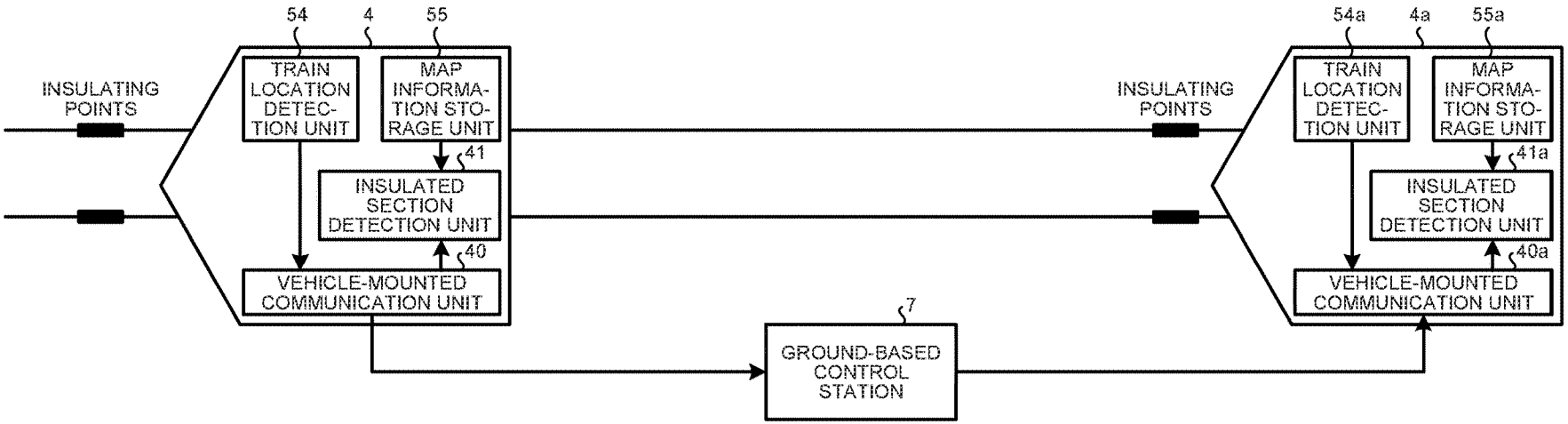
FIG. 4 is a diagram illustrating an example of a situation in which information on the location where that vehicle is present is sent to a following vehicle via a ground-based control station.

FIG. 4 is a diagram illustrating an example of a situation in which information on the location where the vehicle 4 is present is sent to the following vehicle 4*a* via a ground-based control station 7. The train location detection unit 54 of the vehicle 4 detects the location of the train including the vehicle 4, and outputs detected location to the vehicle-mounted communication unit 40. The vehicle-mounted communication unit 40 sends the information on the location of the train including the vehicle 4 to the ground-based control station 7 via wireless communication. The ground-based control station 7 sends the information on the location of the vehicle 4 to the vehicle-mounted communication unit 40*a* of the vehicle 4*a*. The insulated section detection unit 41 of the vehicle 4*a* collates the train location output by the vehicle-mounted communication unit 40*a* with information on locations of insulated sections stored in the map information storage unit 55*a* to thereby detect the information on the location of the insulated section where the vehicle 4 is present. This configuration enables each vehicle to identify the information on the location of the insulated section where the train of its own is present and the information on the location of the insulated section where the preceding train is present.

Another preferable method for preventing false detection, as described below, includes providing the ground with a mechanism for counting the number of vehicles present in an insulated section such that the counted number of vehicles is sent to the rail breakage detection unit. In addition, the rail breakage detection unit 51 is preferably designed not to determine that rail breakage occurs, even when the rail signal reception devices 2 of other than the leading vehicle among plural vehicles are not receiving rail signals in a case where the plural vehicles are present in the same section.

Figure 5:
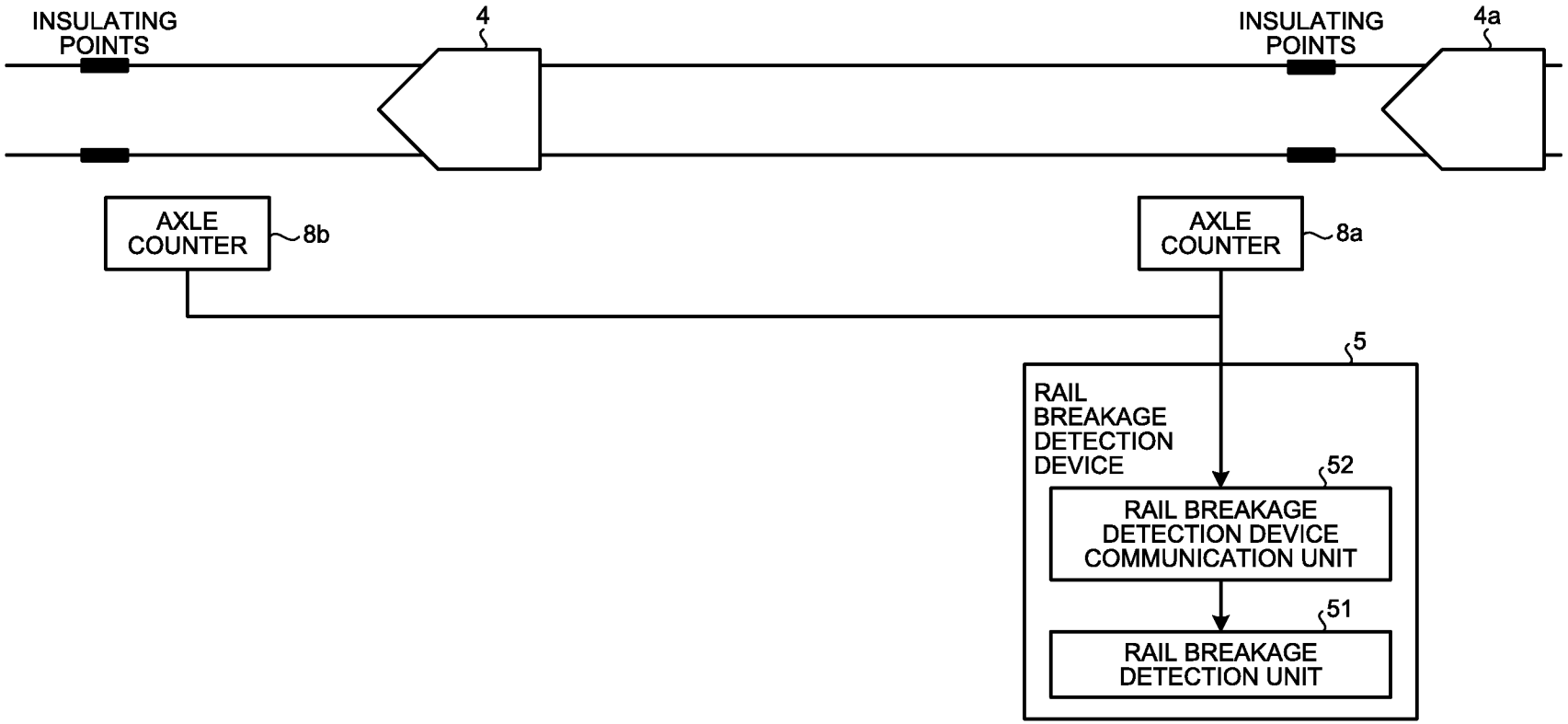
FIG. 5 is a diagram illustrating an example in which a mechanism for counting the number of vehicles is implemented by an axle counter serving as a substitute block system.

FIG. 5 is a diagram illustrating an example in which a mechanism for counting the number of vehicles is implemented by an axle counter serving as a substitute block system. An axle counter 8*a* counts up the number of axles when a vehicle enters that insulated section, and sends the result to the rail-breakage-detection-device communication unit 52. An axle counter 8*b* counts down the number of axles when a vehicle passes through that insulated section, and sends the result to the rail-breakage-detection-device communication unit 52. The rail breakage detection unit 51 makes a determination on rail breakage only for a vehicle entering the insulated section with the number of axles being 0, and does not determine that rail breakage occurs, for a vehicle entering the insulated section with the number of axles being a natural number.

Figure 6:
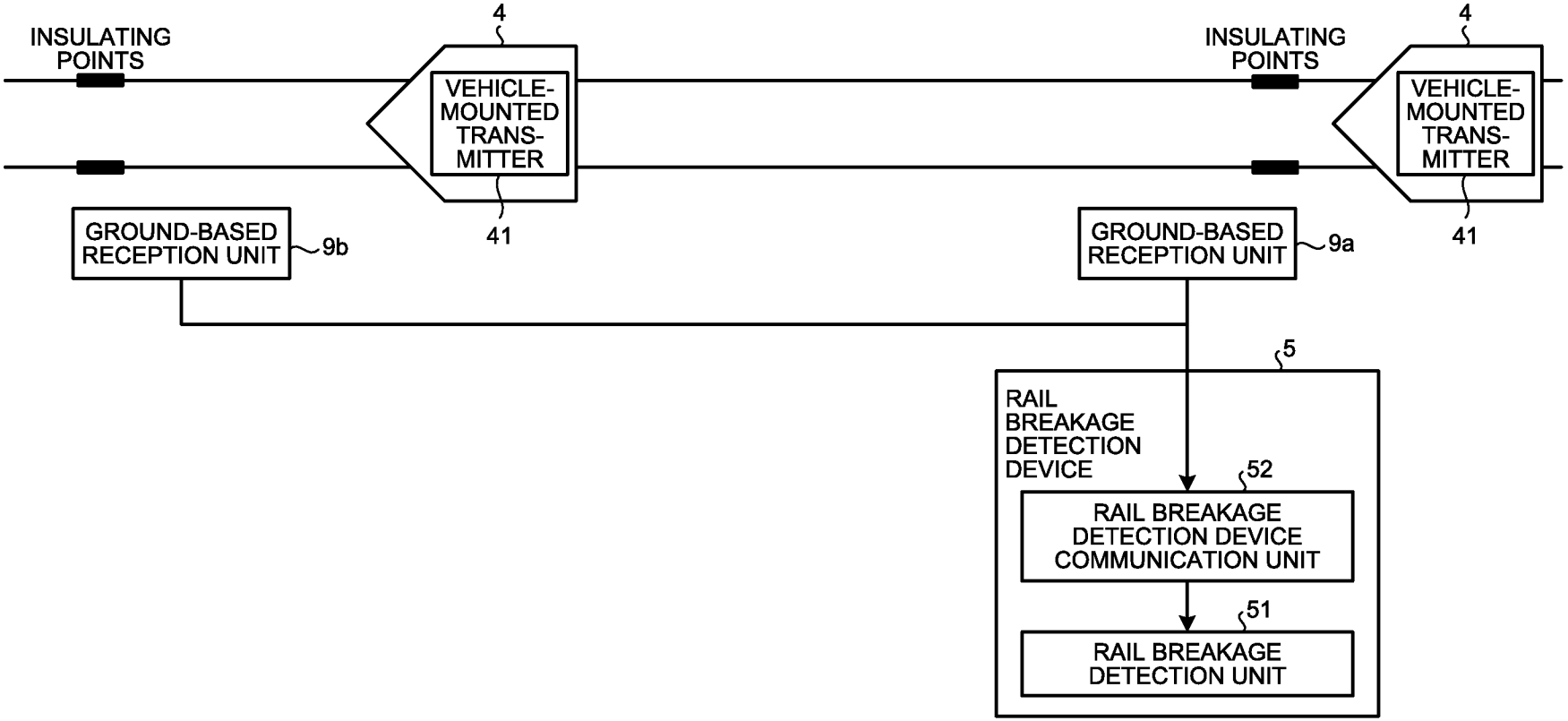
FIG. 6 is a diagram illustrating an example in which a mechanism for counting the number of vehicles of a train is implemented by a vehicle-mounted transmitter installed on a train and a ground-based reception unit installed on the ground.

FIG. 6 is a diagram illustrating an example in which a mechanism for counting the number of vehicles of a train is implemented by a vehicle-mounted transmitter installed on a train and a ground-based reception unit installed on the ground. A ground-based reception unit 9*a* receives a signal from the vehicle-mounted transmitter 41 to thereby detect that the vehicle has entered the insulated section. A ground-based reception unit 9*b* receives a signal from the vehicle-mounted transmitter 41 to thereby detect that the vehicle has passed through the insulated section. The rail breakage detection unit 51 makes a determination on rail breakage only for a vehicle entering the insulated section with the number of vehicles present in that insulated section being 0, and does not determine that rail breakage occurs, for a vehicle entering the insulated section with the number of vehicles being a natural number. This configuration can prevent false detection of rail breakage that may occur when plural vehicles are present within a section defined by insulating points.

Figure 7:
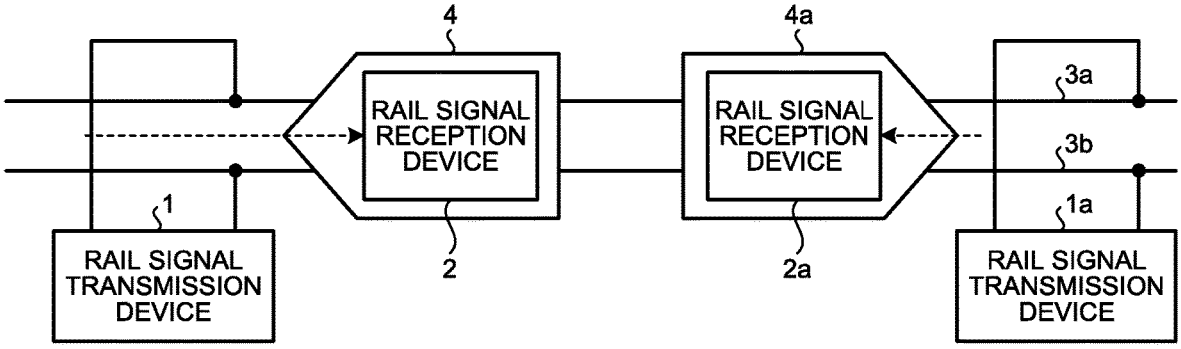
FIG. 7 is a diagram illustrating a state in which the insulating points are removed from the configuration of FIG. 2.
Figure 8:
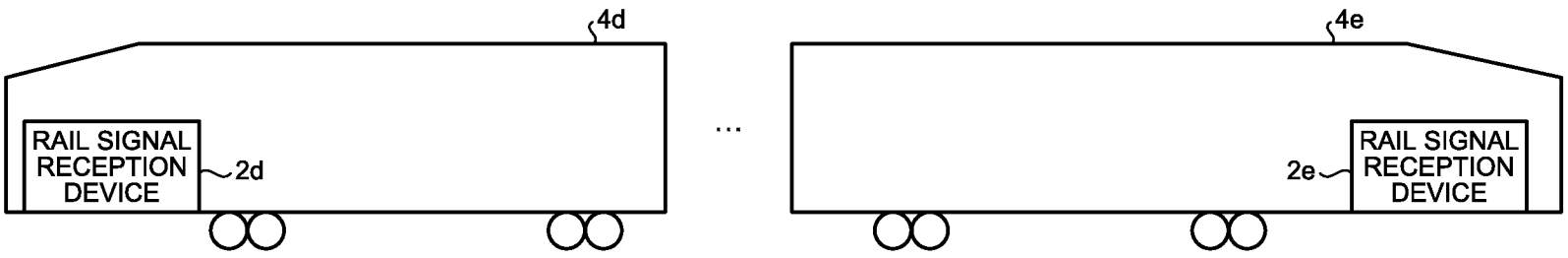
FIG. 8 is a diagram illustrating a situation in which a rail signal reception device is mounted on each of the leading vehicle and the trailing vehicle of a train.

FIG. 7 is a diagram illustrating a state in which the insulating points are removed from the configuration of FIG. 2. FIG. 7 also differs from FIG. 2 in that the vehicle 4 represents a leading vehicle, and the vehicle 4*a* represents a trailing vehicle of a train set other than the train set including the vehicle 4. FIG. 8 is a diagram illustrating a situation in which a rail signal reception device is mounted on each of a leading vehicle 4*d* and a trailing vehicle 4*e* of a train. A rail signal reception device 2*d* is disposed ahead of the foremost axle of the vehicle 4*d*, and a rail signal reception device 2*e* is disposed behind the rearmost axle of the vehicle 4*e*. With such a configuration, in FIG. 7, no electrically insulated points exist in the pair of the rails 3*a* and 3*b* between the rail signal transmission device 1 and the rail signal transmission device 1*a*. In this case, the rail signal reception devices 2 and 2*a* can distinguish between a rail signal sent by the rail signal transmission device 1 and a rail signal sent by the rail signal transmission device 1*a*. For example, a rail signal sent by the rail signal transmission device 1 and a rail signal sent by the rail signal transmission device 1*a* use different frequencies such that the rail signal reception devices 2 and 2*a* can determine that a rail breakage location is ahead of, or behind, the vehicle 4 or 4*a*, in accordance with the rail signal received. This configuration enables rail breakage to be detected even when plural vehicles are present within one section.

According to the present embodiment, rail breakage can be detected by using a vehicle-mountable device. This can provide improved maintainability as compared to the case where a rail signal transmission device and plural rail breakage detection devices are installed on the ground. A vehicle-mounted rail breakage detection device can be maintained in a barn. In particular, with the barn equipped with maintenance tools, the vehicle out of service is brought to the barn for maintenance. Such maintenance requires a lower cost than maintenance involving movement of the maintenance tools.

Note that the rail breakage detection device of the present invention is not limited to one that is mounted on a vehicle, but may be installed on the ground. That is, rail breakage detection may be performed on the ground using information from a vehicle-mounted rail signal reception device. In this case, the rail breakage detection device is preferably installed in a ground-based hub together with ground-based hub device rather than being installed one-by-one on the ground together with the rail signal transmission device.

Second Embodiment

Figure 9:
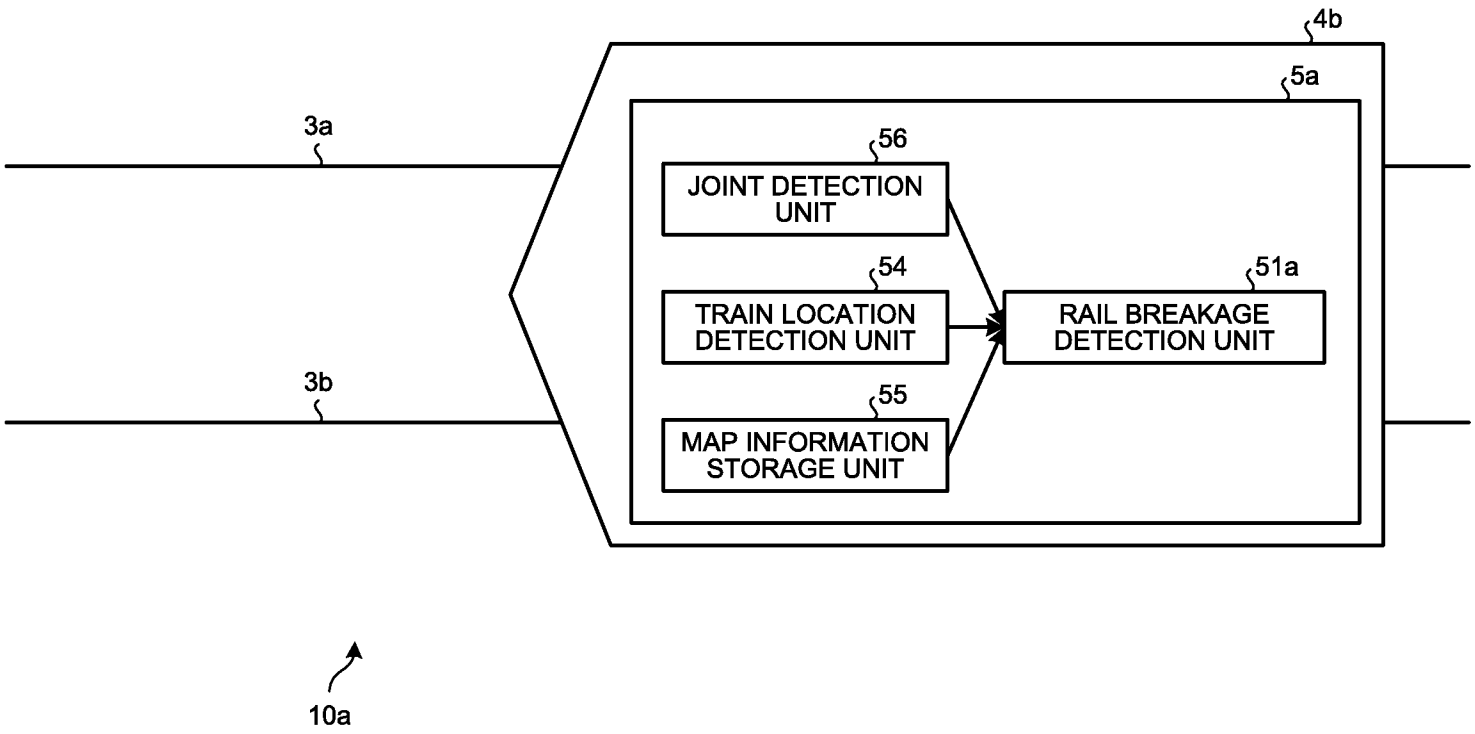
FIG. 9 is a diagram illustrating one example configuration of a rail breakage detection system including a rail breakage detection device according to a second embodiment.

FIG. 9 is a diagram illustrating one example configuration of a rail breakage detection system including a rail breakage detection device according to a second embodiment of the present invention. A rail breakage detection system 10*a* illustrated in FIG. 9 includes a rail breakage detection device 5*a*. The rail breakage detection device 5*a* is mounted on a vehicle 4*b*, and includes a rail breakage detection unit 51*a*, a joint detection unit 56, the train location detection unit 54, and the map information storage unit 55.

The joint detection unit 56 detects that the vehicle 4*b* has passed over joints of the respective rails 3*a* and 3*b*, and then outputs joint detection information. A joint detection method performed by the joint detection unit 56 is, for example, a method for detecting the joint by using an expansion gap sensor for measuring the size of an expansion gap, which is a gap in a rail joint.

Alternatively, the vehicle 4*b* may include an acceleration sensor, and the joint detection unit 56 can then detect the joint by determining that the joint exists at the location of the vehicle 4*b* at a time point when the acceleration value measured by this acceleration sensor exceeds a preset threshold. Furthermore, the joint detection unit 56 provides the same output upon passage of the vehicle over a rail breakage location as the output upon passage of the vehicle over a rail joint. Thus, use of train location information from the train location detection unit 54 and of map information from the map information storage unit 55 enables the joint detection unit 56 to detect the passage over the rail breakage location as well.

The train location detection unit 54 detects the location of the vehicle 4*b*, and outputs train location information. The location of the vehicle 4*b* can be detected by, for example, totaling the number of rotations of an axle of the vehicle 4*b*. The location of the vehicle 4*b* may also be detected by using a satellite positioning system, including a global positioning system (GPS). Alternatively, the location of the vehicle 4*b* may be detected by calculation of the travel distance of the vehicle using an inertial navigation system installed on the vehicle 4*b*. The map information storage unit 55 stores map information including information that associates a rail joint location with a rail kilometrage, and outputs this map information.

The rail breakage detection unit 51*a* detects rail breakage on the basis of the joint detection information from the joint detection unit 56, of the train location information from the train location detection unit 54, and of the map information from the map information storage unit 55. Specifically, in a case in which the location of the vehicle 4*b* at a time point when the joint detection unit 56 detected a joint does not match any rail joint location contained in the map information, the rail breakage detection unit 51*a* determines that this location is a rail breakage location.

Figure 10:
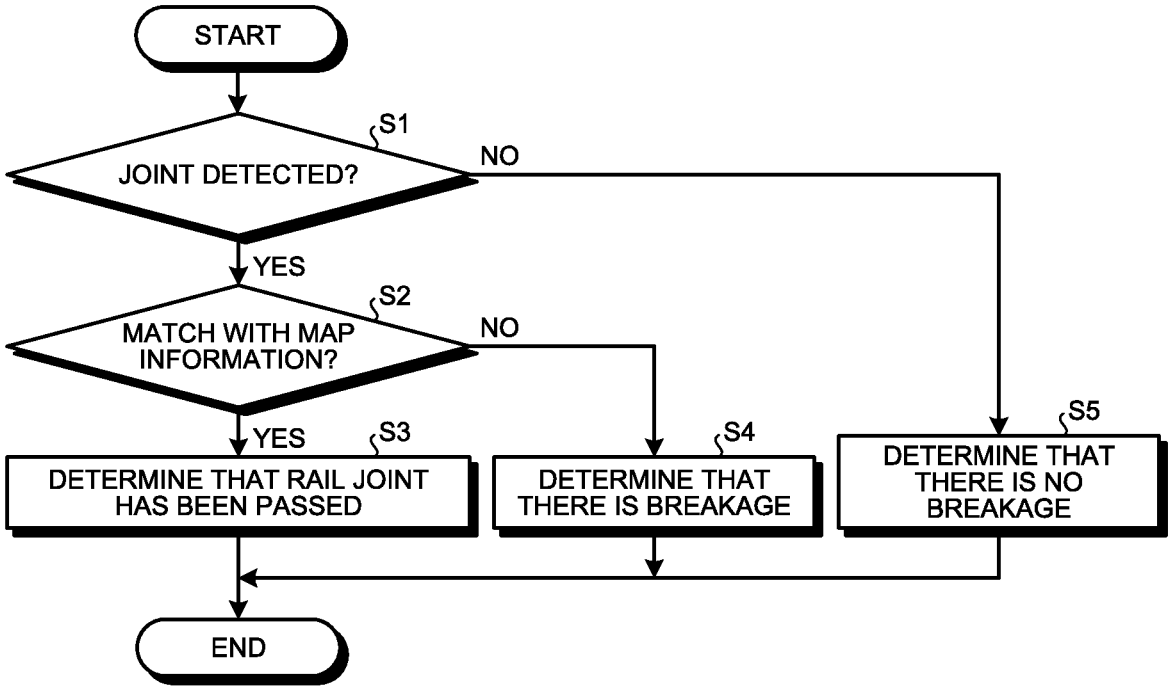
FIG. 10 is a flowchart illustrating one example of operation of the rail breakage detection unit illustrated in FIG. 9.

FIG. 10 is a flowchart illustrating one example of operation of the rail breakage detection unit 51*a* illustrated in FIG. 9. Note that the process illustrated in FIG. 10 is repeated at regular time intervals. At the beginning of the process, the rail breakage detection unit 51*a* refers to the joint detection information from the joint detection unit 56, and determines whether a joint has been detected (S1). If no joint has been detected (S1: No), the rail breakage detection unit 51*a* determines that there is no breakage (S5), and thus terminates the process. If the joint has been detected (S1: Yes), the rail breakage detection unit 51*a* determines whether the location of the joint detection matches any rail joint location contained in the map information from the map information storage unit 55 (S2). If the location of the joint detection does not match any information of the map information (S2: No), the rail breakage detection unit 51*a* determines that there is breakage (S4), and thus terminates the process. If the location of the joint detection matches certain information of the map information (S2: Yes), the rail breakage detection unit 51*a* determines that the rail joint has been passed over (S3), and thus terminates the process.

According to the present embodiment, whether there is rail breakage or not can be determined using only vehicle-mounted devices.

Third Embodiment

Figure 11:
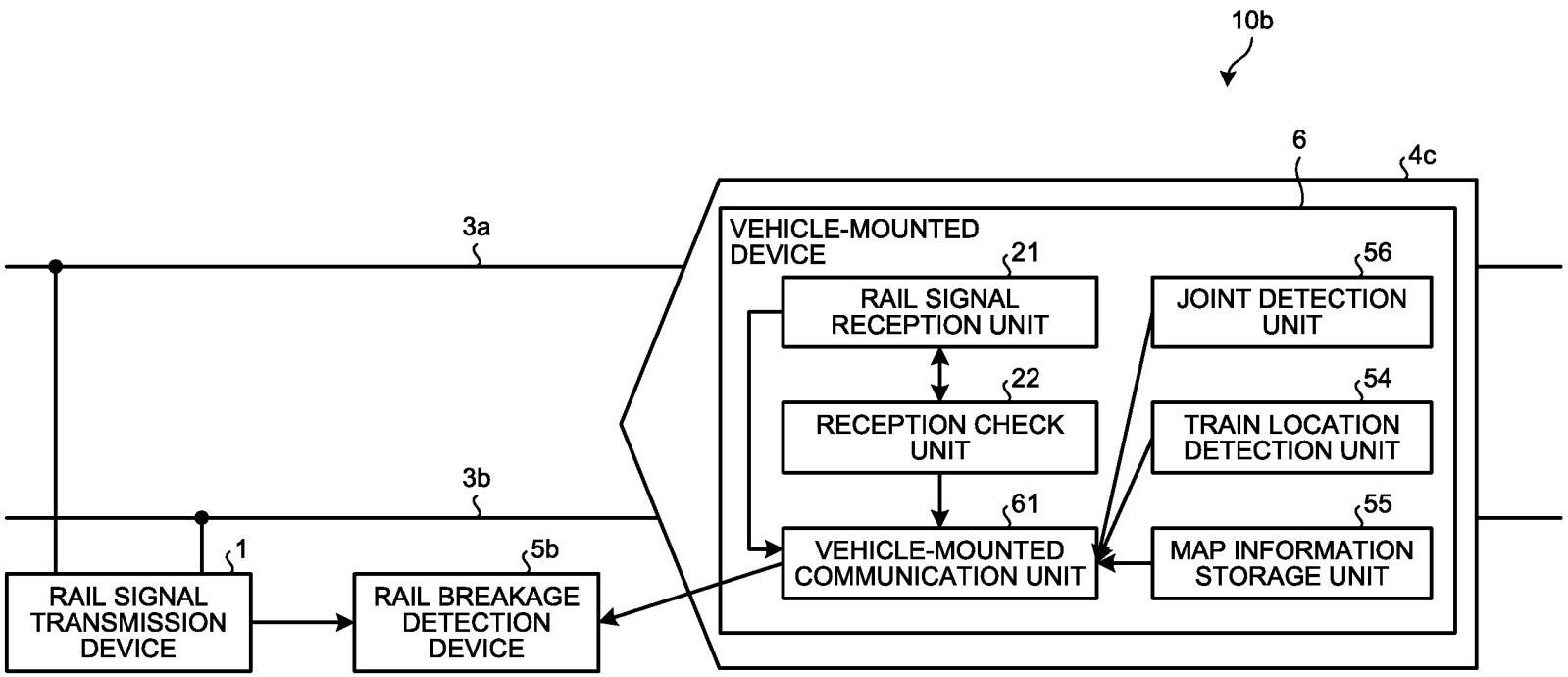
FIG. 11 is a diagram illustrating one example configuration of a rail breakage detection system including a rail breakage detection device according to a third embodiment.

FIG. 11 is a diagram illustrating one example configuration of a rail breakage detection system including a rail breakage detection device according to a third embodiment of the present invention. A rail breakage detection system 10*b* illustrated in FIG. 11 includes the rail signal transmission device 1, a rail breakage detection device 5*b*, and a vehicle-mounted device 6 mounted on a vehicle 4*c*. The rail signal transmission device 1 has been described in the first embodiment, and the description thereof will thus be omitted. The rail breakage detection device 5*b* detects rail breakage from information from the vehicle-mounted device 6.

The vehicle-mounted device 6 includes the rail signal reception unit 21, the reception check unit 22, the joint detection unit 56, the train location detection unit 54, the map information storage unit 55, and a vehicle-mounted communication unit 61. The rail signal reception unit 21, the reception check unit 22, the joint detection unit 56, the train location detection unit 54, and the map information storage unit 55 have been described in the first and second embodiments, and the description thereof will thus be omitted. The vehicle-mounted communication unit 61 sends, to the rail breakage detection device 5*b*, the reception state information from the rail signal reception unit 21, the reception-device state information from the reception check unit 22, the joint detection information from the joint detection unit 56, the train location information from the train location detection unit 54, and the map information from the map information storage unit 55.

Figure 12:
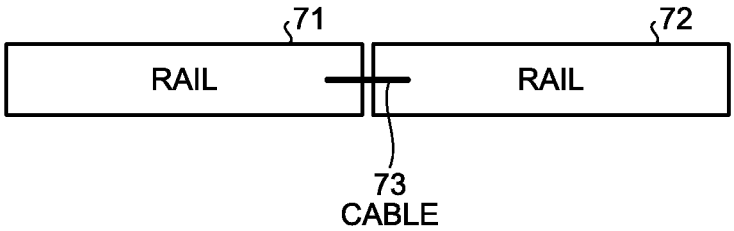
FIG. 12 is a schematic diagram illustrating a rail joint.

FIG. 12 is a schematic diagram illustrating a rail joint. The rail joint illustrated in FIG. 12 employs a rail bond having a cable 73 electrically interconnecting a rail 71 and a rail 72 on the lateral side of the rails. In the configuration illustrated in FIG. 12, cutting of the cable 73 will result in loss of electrical continuity between the rail 71 and the rail 72.

When the vehicle 4 described in the first embodiment moves past a cut portion of the cable 73, the rail breakage detection device 5 determines that rail breakage has occurred there. Meanwhile, when the vehicle 4*b* described in the second embodiment moves past a cut portion of the cable 73, the rail breakage detection device 5*a* determines that a rail joint is passed over. However, according to the present embodiment, a location where the rail joint is detected can be identified as a location having the rail joint with the cable being cut where the voltage induced by a rail signal crosses a preset voltage threshold. Thus, the present embodiment can even detect the cable of the rail bond being cut, which is undetectable in the first and second embodiments.

Figure 13:
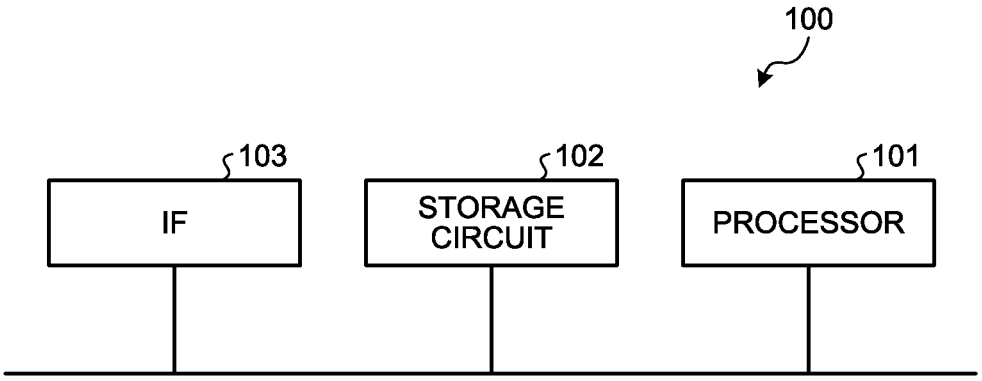
FIG. 13 is a diagram illustrating an example of a typical configuration of hardware to implement the rail breakage detection device illustrated in FIG. 1.

A hardware configuration for implementing the rail breakage detection device according to each of the first to third embodiments will next be described. FIG. 13 is a diagram illustrating an example of a typical configuration of hardware to implement the rail breakage detection device 5 illustrated in FIG. 1. FIG. 13 illustrates hardware 100 including a processor 101, a storage circuit 102, and an interface (IF) 103. The processor 101 is typically a central processing unit (CPU), and executes a program for computation. The storage circuit 102 stores a program to be executed by the processor 101, and stores data needed for the processor 101 to execute the program for computation. The rail breakage detection unit 51 is implemented by the processor 101 and the storage circuit 102. The IF 103 is a component for implementing external inputting into and outputting from the rail breakage detection device 5, and the IF 103 implements the rail-breakage-detection-device communication unit 52. Note that the processor 101, the storage circuit 102, and the IF 103 may be plural in number.

Although not illustrated, the rail breakage detection systems 10, 10*a*, and 10*b* may each include a train speed control device. In this case, upon detection of rail breakage in the rail breakage detection system 10, 10*a*, or 10*b*, the rail breakage detection device 5, 5*a*, or 5*b* outputs a rail breakage detection signal, and upon reception of this rail breakage detection signal, the train speed control device provides control to limit the train speed at the rail breakage location. This configuration enables prompt limitation on the train speed at the rail-breakage-detected location. The train speed control device may be mounted on a vehicle similarly to the rail breakage detection devices 5, 5*a*, and 5*b*, but the arrangement is not limited thereto, and the train speed control device may thus be installed on the ground with a ground-based hub device.

The configurations described in the foregoing embodiments are merely examples of various aspects of the present invention. These configurations may be combined with a known other technology, and moreover, a part of such configurations may be omitted and/or modified without departing from the spirit of the present invention.

REFERENCE SIGNS LIST

1, 1*a* rail signal transmission device; 2, 2*a*, 2*d*, 2*e* rail signal reception device; 3*a*, 3*b* rail; 4, 4*a*, 4*b*, 4*c*, 4*d*, 4*e* vehicle; 5, 5*a*, 5*b* rail breakage detection device; 6 vehicle-mounted device; 7 ground-based control station; 8*a*, 8*b* axle counter; 9*a*, 9*b* ground-based reception unit; 10, 10*a*, 10*b* rail breakage detection system; 11 transmission device power supply; 12 transmission device resistor; 13 transmission device current measurement unit; 14 transmission device power consumption calculation unit; 15 transmission device communication unit; 16 transmission check unit; 21 rail signal reception unit; 22 reception check unit; 23 reception device communication unit; 51, 51*a* rail breakage detection unit; 52 rail breakage detection device communication unit; 53 rail breakage decision condition storage unit; 54 train location detection unit; 55 map information storage unit; 56 joint detection unit; 61 vehicle-mounted communication unit; 71, 72 rail; 73 cable; 100 hardware; 101 processor; 102 storage circuit; 103 IF.

The invention claimed is:

1. A rail breakage detection device, wherein the rail breakage detection device receives:

transmitter state information indicating whether a rail signal transmitter to send a rail signal is normal, receiver state information indicating whether a rail signal receiver, mounted on a train, to receive a voltage induced by the rail signal is normal, and reception state information indicating whether an induced voltage is received by the rail signal receiver, and the rail breakage detection device performs rail breakage detection on a basis of the transmitter state information, the receiver state information, and the reception state information, wherein the rail breakage detection device determines that rail breakage occurs in a case where the transmitter state information and the receiver state information are normal, and the reception state information is abnormal, unless there are a plurality of trains in a same insulating section of the rail and the train is not a first train in the same insulating section.

2. The rail breakage detection device according to claim 1, wherein, in a case where the reception state information is abnormal, a vehicle location at a time point when the induced voltage is not received by the rail signal receiver is identified as a rail breakage location.

3. A rail breakage detection device, comprising:

a seam detector which detects passage of a joint of a rail and outputs seam detection information;

a train position detector which detects a position of a vehicle of a train and outputs train Position information;

a map storage which stores information on map information including information associating parts of the rail with joints of the rail, and outputs the map information;

the rail breakage detection device receives transmitter state information, receiver state information, and reception state information, the transmitter state information indicating whether a rail signal transmitter to send a rail signal is normal, the receiver state information indicating whether a rail signal receiver to receive a voltage induced by the rail signal is normal, the reception state information indicating whether an induced voltage is received by the rail signal receiver, the rail breakage detection device performs rail breakage detection on a basis of the transmitter state information, the receiver state information, and the reception state information, wherein the rail breakage detection device determines that rail breakage occurs in a case where the transmitter state information and the receiver state information are normal, and the reception state information is abnormal, wherein, in a case where the transmitter state information and the receiver state information are normal and the reception state information is normally received, a location where a voltage induced by the rail signal crosses a preset voltage threshold is identified as a rail breakage location, and wherein when the identified rail breakage location coincides with a particular joint of the rail in the map information, a determination is made that a cable interconnecting parts of the rail has been cut.

4. A rail breakage detection system comprising:

a rail signal transmitter to send a rail signal while checking an operational state of the rail signal transmitter and outputting transmitter state information;

a rail signal receiver, mounted on a train, to receive a voltage induced by the rail signal and output reception state information while checking an operational state of the rail signal receiver and outputting receiver state information; and a rail breakage detector to detect breakage of a rail on a basis of the transmitter state information, the receiver state information, and the reception state information, wherein the rail breakage detector determines that rail breakage has not occurred in a case where the transmitter state information and the receiver state information are normal, and the reception state information is abnormal, when there are a plurality of trains in a same insulating section of the rail.

5. The rail breakage detection system according to claim 4, wherein the rail breakage detector is mounted on a vehicle of the train.

6. The rail breakage detection system according to claim 5, further comprising a train speed controller to limit a speed of the train at a location of the breakage of the rail, the train speed controller being disposed on a ground or a vehicle.

7. The rail breakage detection system according to claim 4, further comprising a train speed controller to limit a speed of the train at a location of the breakage of the rail, the train speed controller being disposed on a ground or a vehicle.

* * * * *